US005238276A

United States Patent [19]

Burns

[11] Patent Number: 5,238,276

[45] Date of Patent: Aug. 24, 1993

[54] VEHICLE HANDLE ATTACHING ARRANGEMENT

[75] Inventor: James A. Burns, Orion, Mich.

[73] Assignee: Chrysler Corporation, Highland Park, Mich.

[21] Appl. No.: 993,565

[22] Filed: Dec. 21, 1992

[51] Int. Cl.[5] ..... E05C 21/00

[52] U.S. Cl. ..... 292/347; 292/DIG. 31; 292/DIG. 53; 292/337

[58] Field of Search ..... 292/337, 347, 256, 336.3, 292/DIG. 31, DIG. 53

[56] References Cited

U.S. PATENT DOCUMENTS

| | | | |
|---|---|---|---|
| 1,818,317 | 8/1931 | Gilmore | 292/256 X |
| 2,582,816 | 1/1952 | Bonnell | 292/256 X |
| 4,892,342 | 1/1990 | Newman et al. | 292/DIG. 53 X |
| 5,064,228 | 11/1991 | Bishing | 292/DIG. 31 X |

*Primary Examiner*—Richard E. Moore

*Attorney, Agent, or Firm*—Edward P. Barthel

[57] ABSTRACT

A handle assembly, comprising a release handle mounted within a recess of the handle housing, is adapted for installation in a vehicle door panel aperture from the exterior thereof. The housing is formed with a terminal flange provided with an upper omitted segment extending longitudinally between a pair of upright handle support brackets. An elongated retaining rib is formed between the brackets having an outboard face offset a predetermined dimension inboard from the plane of the terminal flange backside. The housing is mounted in the panel aperture in a rocked-in manner with its terminal flange overlying the aperture recessed flanged border while the retaining rib face locates to the inboard surface of the flanged border. The housing central body has an inboard projecting stem adapted to support a clip whereby the clip, when fixed to the stem by a fastener, locks the handle assembly in the panel aperture.

8 Claims, 5 Drawing Sheets

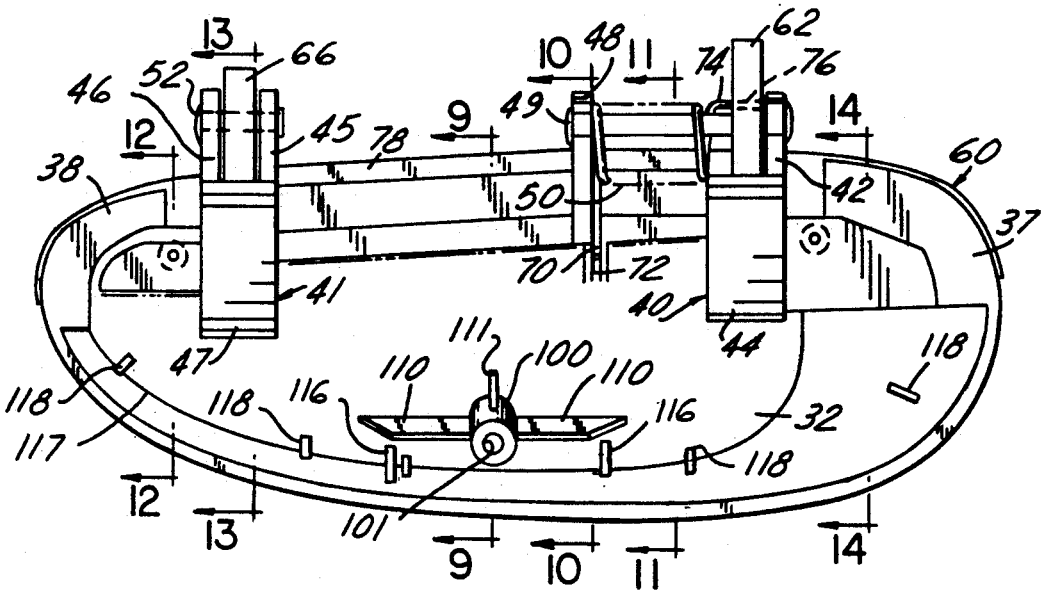
FIG. 4
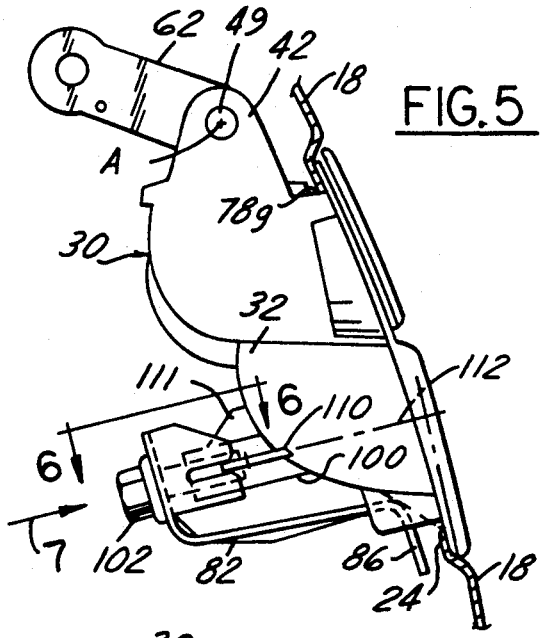
FIG. 5
FIG. 6
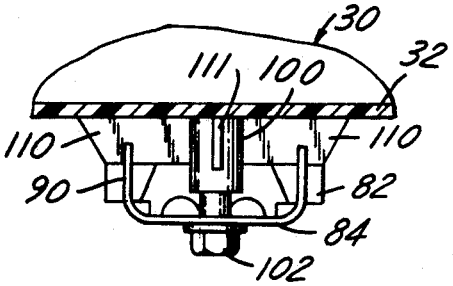
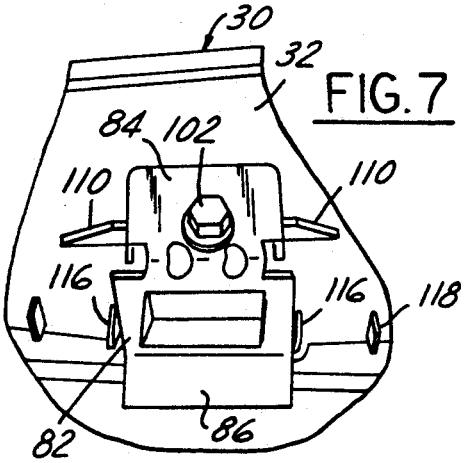
FIG. 7
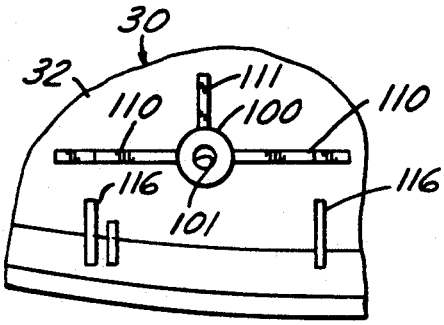
FIG. 8

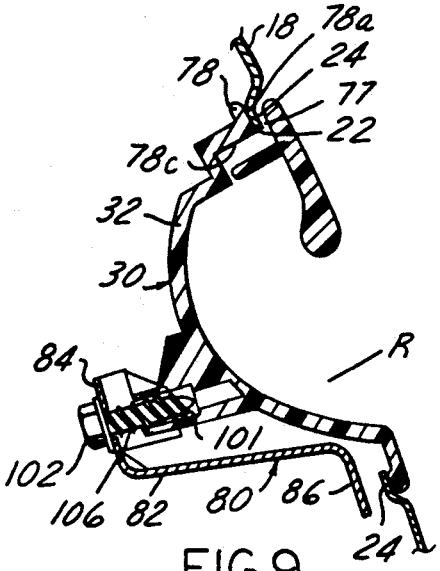
FIG.9
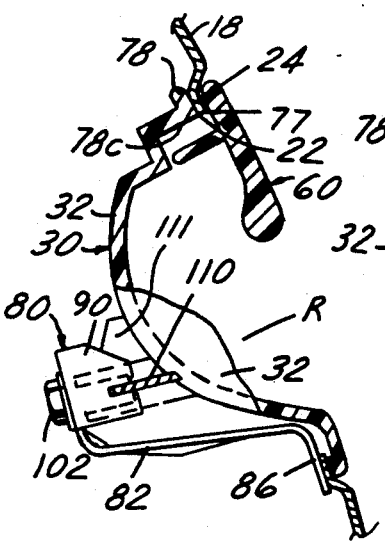
FIG.10
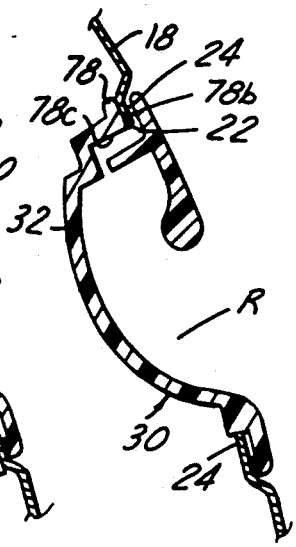
FIG.11
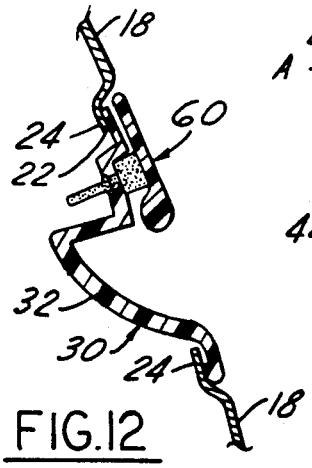
FIG.12
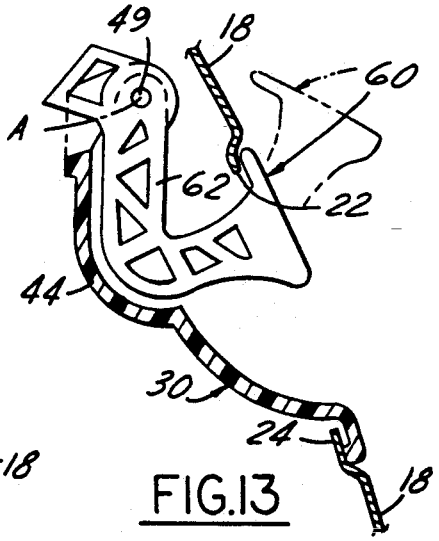
FIG.13
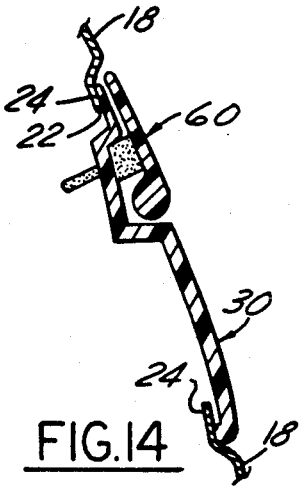
FIG.14
FIG.15
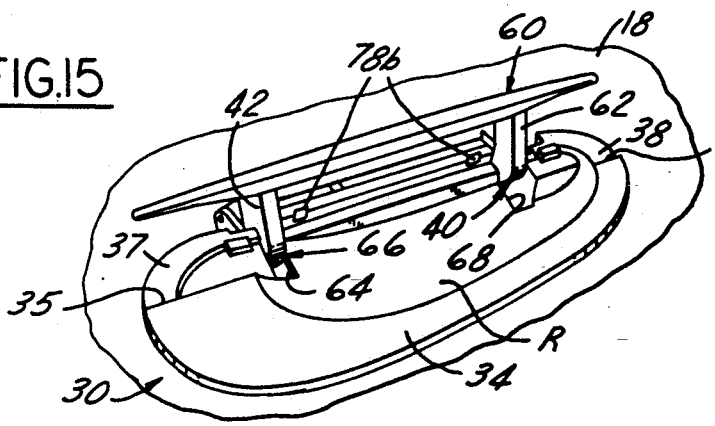
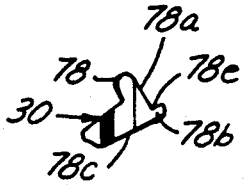
FIG.11A

VEHICLE HANDLE ATTACHING ARRANGEMENT

BACKGROUND OF THE INVENTION

This invention relates generally to vehicle exterior handles and, more particularly, to an arrangement for mounting a vehicle flush-type handle assembly to a body panel for actuating a door latch mechanism or the like.

One example of a prior art outside door handle mounting arrangement presently used on Chrysler Corporation vehicles is shown in the U.S. Pat. No. 4,892,342 issued to Newman et al. on Jan. 9, 1990. Vehicle handles, such as the Newman et al. door handle, are adapted for mounting in a rectangular-shaped opening defined by inwardly directed right-angled stiffening flange extending continuously around the opening. The Newman stiffening flange, which cooperates with a spring rod retainer to secure the handle housing in the panel opening, does not permit mounting a handle housing in a flush manner with the outer surface of the panel.

SUMMARY OF THE INVENTION

Accordingly, it is a feature of the present invention to provide a novel mounting arrangement for securing a handle housing in a vehicle panel aperture defined by a flanged border such that, with a terminal flange of the housing seated on the flanged border outboard surface, a retainer rib formed on an upper portion of the housing has an inboard offset face in mating contact with an opposed portion of the border inner surface whereby the housing is locked in the panel aperture by a single clip member.

It is another feature of the present invention to provide a novel mounting arrangement for a handle housing as set forth above wherein the clip member is secured by a single threaded fastener.

It is still another feature of the present invention to provide a novel mounting arrangement for a handle housing as set forth above wherein the clip member has a generally double-L shape in section comprising a body panel formed with an upstanding apertured head panel at one inboard transverse bend juncture at one end and a depending foot panel at a transverse bend juncture at the opposite end.

It is still another feature of the present invention to provide a novel mounting arrangement for a handle housing as set forth above wherein the housing central portion is formed with an inboard projecting stem portion having its free end thereof formed with an axial bore receiving the single fastener therein upon being inserted through a hole in the clip member head panel whereby the clip is retained on the stem portion free end.

It is a further feature of the present invention to provide a novel mounting arrangement for a handle housing as set forth above wherein said head panel having a pair of outboard projecting ear portions each formed with an open ended slot sized to slidably receive therewithin an associated guide fillet formed on respective sides of the housing stem portion.

It is another feature of the present invention to provide a novel mounting arrangement for securing a handle housing in a vehicle panel aperture as set forth above wherein the housing terminal flange having an upper omitted segment extending between a pair of longitudinally spaced upstanding brackets and the upper retaining rib extending between handle brackets with the rib face offset a predetermined dimension from a plane that includes the backside of the terminal flange.

A vehicle door handle assembly comprises a handle housing formed with a terminal flange surrounding a central concavo-convex shaped central body providing inner and outer arcuately contoured surfaces. The central body defines an inwardly depressed recess on its outboard side for receiving a release handle therein. A pair of longitudinally spaced upstanding handle pivot support brackets are provided on the housing central body outer arcuately contoured surface. Each pivot bracket has a hinge pin supporting a handle crankarm providing swinging movement of the handle from its normal flush position concealed in the housing recess to an upwardly pivoted release position.

The housing terminal flange has an upper elongated omitted segment extending longitudinally along the housing upper portion between the a pair of pivot brackets. A longitudinal retaining rib, having its outboard face offset a predetermined dimension from a plane that includes the terminal flange backside, extends between the pair of pivot brackets. The retaining rib is formed with notch means in the form of a plurality of tabs projecting outboard from the underside thereof defining, with the rib offset face, a pair of substantially right-angled locating junctures.

The release handle, in its non-use state, has its inner surface contacting the housing terminal flange outer surface bridging the omitted segment. As a result, an elongated gaped area is defined intermediate the retaining rib offset face and the handle opposed inner surface. The installer mounts the handle assembly by initially orienting or tilting the handle assembly inboard such that the pair of pivot brackets are initially inserted through the panel aperture. This orientation permits an upper edge portion of the aperture flanged border to be received in the gaped area such that the panel aperture edge is seated in a predetermined manner by engaging the right-angled locating junctures. The junctures establish a determined rotational pivot axis about which the housing is rockable enabling the installer to swing the housing downwardly so as to seat its terminal flange on the aperture flanged border.

The housing central portion is provided with an inboard protruding stem having its free end axially bored for reception of a threaded fastener therein. A one piece double-L sectioned clip member, stamped from sheet material, comprises a base panel formed with an upstanding head panel at one end and a foot panel depending from an opposite end. The head panel has a hole receiving a fastener therethrough for threaded engagement in the stem axial bore. Tightening the fastener head panel on the stem free end urges the foot panel into abutment with a lower inner surface portion of the panel flanged border thereby positively locking the housing in the panel aperture.

The clip head panel, which is channel-shaped in horizontal section, defines a pair of right-angled ears projecting so as to partially overlie the clip base panel. Each ear is formed with an open-ended slot sized to receive therein a blade-like fillet formed on either side of the stem thereby readily locating the clip thereon in an aligned manner prior to the fastener being threaded into the stem axial bore.

BRIEF DESCRIPTION OF THE DRAWINGS

Other features and advantages of the invention, such as improved appearance and service disassembly, will be evident from the following detailed description of the preferred embodiment of the invention and the accompanying drawings wherein:

FIG. 4 is an elevation view of the inboard side of the door handle assembly of the present invention;

FIG. 5 is an end elevation view of the door handle assembly of the present invention;

FIG. 6 is a fragmentary horizontal sectional view, partly in plan, taken in the plane of the line "6—6" of FIG. 5;

FIG. 7 is a fragmentary inboard side plan view taken in the direction of arrow "7" in FIG. 5;

FIG. 8 is a view similar to FIG. 7 with the attaching clip removed;

FIG. 9 is a fragmentary vertical sectional view taken substantially along the line 9—9 of FIG. 4;

FIG. 10 is a fragmentary vertical sectional view taken substantially along the line 10—10 of FIG. 4;

FIG. 11 is a fragmentary vertical sectional view taken substantially along the line 11—11 of FIG. 4;

FIG. 11A is an enlarged fragmentary detail view included in the dashed circle denoted "FIG. 11A" in FIG. 11;

FIG. 12 is a fragmentary vertical sectional view taken substantially along the line 12—12 of FIG. 4;

FIG. 13 is a fragmentary vertical sectional view taken substantially along the line 13—13 of FIG. 4;

FIG. 14 is a fragmentary vertical sectional view taken substantially along the line 14—14 of FIG. 4;

FIG. 15 is a fragmentary perspective view of the handle assembly mounted in the door panel with the handle in its raised or released position;

DETAILED DESCRIPTION OF THE INVENTION

Figure 1:
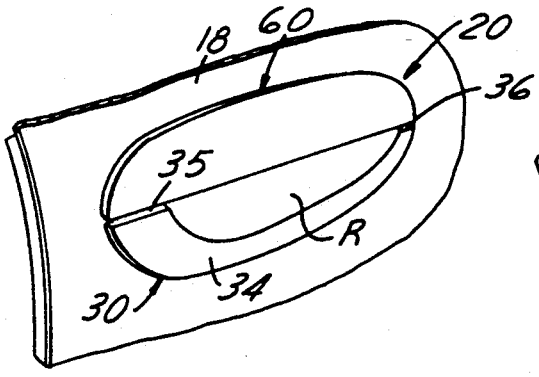
FIG. 1 is a perspective view showing the door handle assembly mounted in a door panel opening with the door handle in its flush or normal door latched position.
Figure 1A:
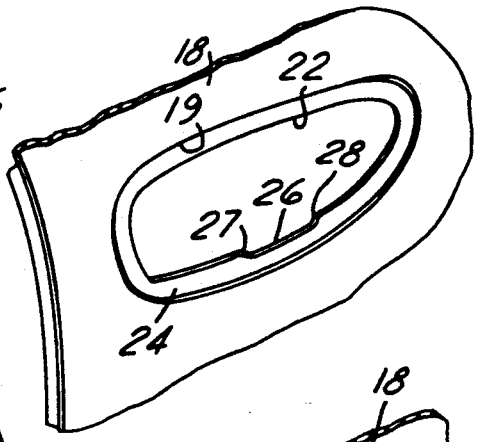
FIG. 1A is a fragmentary perspective view of a door panel outer surface showing an elongated opening therein adapted to receive the door handle assembly of the present invention.

Referring now to the drawings, and more particularly to FIG. 1, there is shown a portion of a panel of a motor vehicle, partially indicated at 18, having an outer surface and an inner surface. The panel 18, which in the disclosed embodiment is a vehicle door exterior panel, has a convex curved contour in vertical section and includes a flush type outside door handle assembly 20 for operating a conventional door latch (not shown). FIG. 1A shows the panel 18 formed with a generally oval-shaped handle aperture 22 configured to accommodate the handle assembly 20. The panel aperture 22 is defined by a continuous oval-shaped flanged border 24, recessed or "counter-sunk" inboard from the panel outer surface which substantially conforms to the aperture 22 and lies in a plane matching the contour of the panel 18. The border 24 lower portion has an elongated central cutout 26 formed therein defined by longitudinally spaced fore and aft lead-in converging beveled edge portions 27 and 28, respectively. The panel aperture 22 is adapted to receive the handle assembly 20 from the outer or outboard side of the door panel 18 in a rocked manner to be described below.

Figure 2:
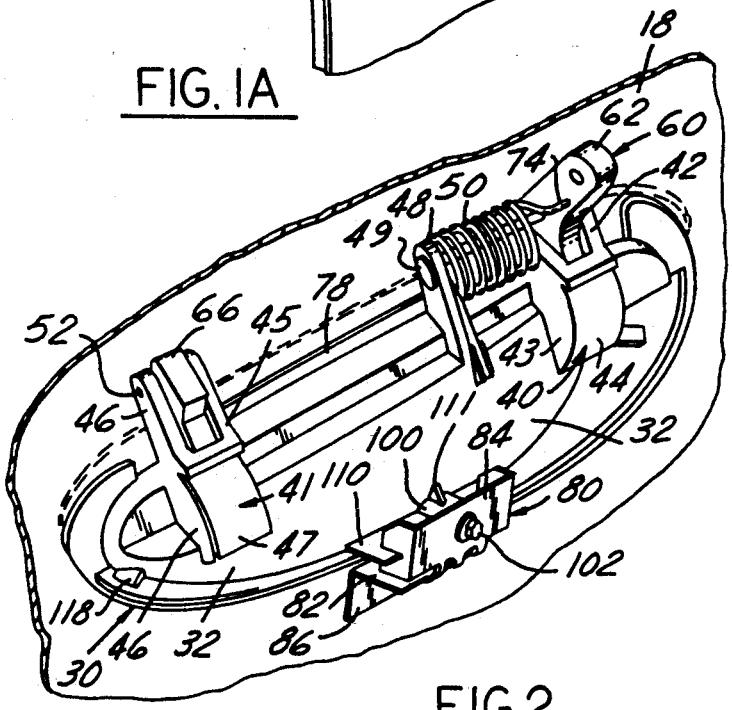
FIG. 2 is a fragmentary perspective view of a door panel inner surface showing the handle assembly mounted thereon.
Figure 3:
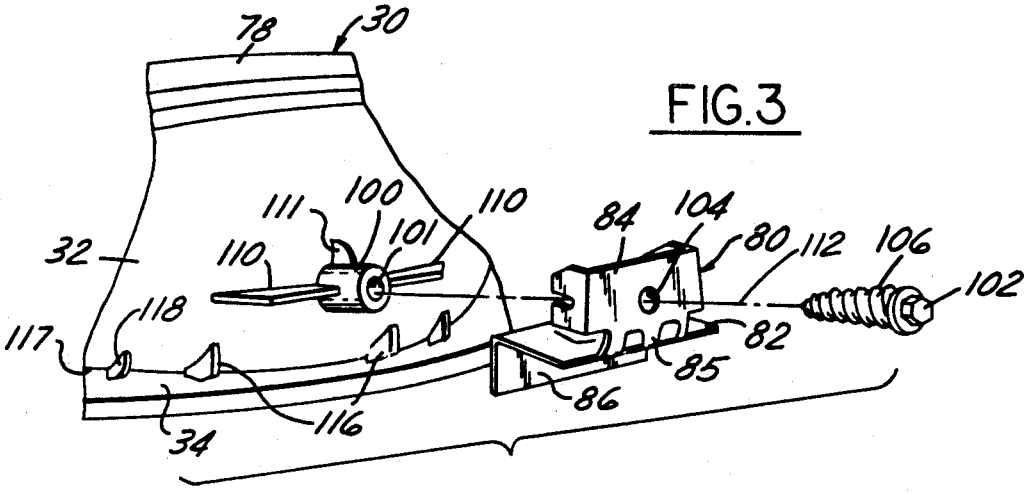
FIG. 3 is a fragmentary exploded perspective view of the inboard central portion of the door handle assembly.

With reference to FIGS. 1, 2 and 3, the handle assembly 20 includes a housing 30 having an inwardly concavo-convex dome-like body portion 32 defining an outwardly opening generally oval-shaped central depression or recess "R" (FIG. 1). The recess "R" is sized for inserting the operator's fingers behind a release handle 60 pivotally mounted on the housing for location between an extended operable position and a retracted inoperable flush position partially closing the opening of the depression. FIGS. 15 depict the housing member central recess "R" having an outwardly extending integral continuous upwardly opening C-shaped terminal flange portion 34 extending around the periphery of the body portion 32 except for an upper terminal flange omitted segment to be described.

The housing terminal flange 34 overlies the exterior surface of the matching panel border flange 24 around a complementary edge contour line 33 of panel aperture 22. As seen best in FIG. 15, the oval-shaped terminal flange portion 34 comprises a crescent shaped lower half sector, terminating at fore and aft horizontally disposed contour lines 35 and 36, respectively, partially defining a pair of substantially mirror image upper arcuate handle flush mounting end sector recesses 37 and 38.

Figure 16:
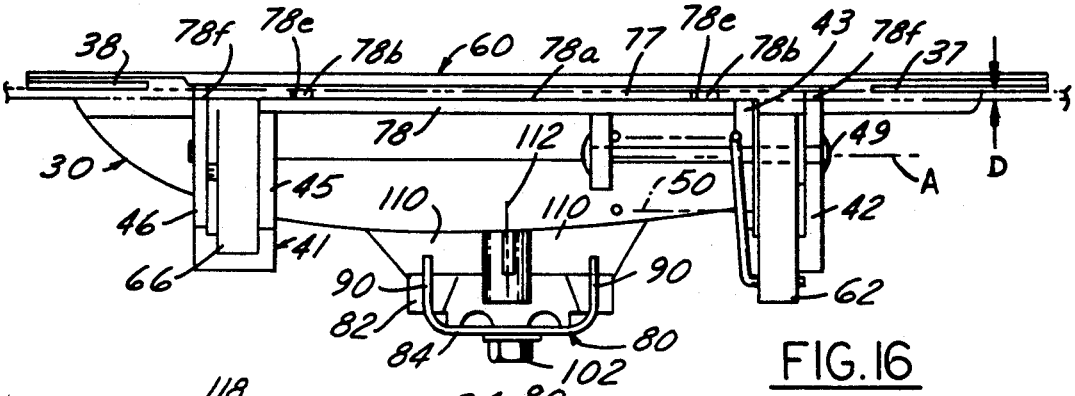
FIG. 16 is a top view of the handle assembly with the door panel shown in dashed lines.

With reference to FIGS. 2 and 16, the housing member 30 is preferably molded from a polymeric or plastic glass filled material with the housing central body portion 32 integrally formed with forward or first 40 and aft or second 41 longitudinally spaced shell-like upstanding pivot brackets. The forward pivot bracket 40 comprises spaced parallel support walls 42, 43 and a bight wall 44 while the aft handle pivot bracket 41 comprises spaced parallel support walls 45, 46 and a bight wall 47. FIG. 5 shows an upper extension of support wall 42 providing a bore which together with an intermediate support wall 48 aligned bore journally receives a first or forward pivot pin 49 surrounded by a return compression coil spring 50. The spring 50 one end abuts the intermediate support wall 48 and the forward pivot pin 49 is aligned on release handle pivot axis "A", as seen in FIG. 4. A second or aft pivot pin 52 is journally supported on the pivot axis "A" by means of a pair of aligned bores provided in respective upper extensions of support walls 45 and 46.

It will be noted that an integral cylindrical shaped hollow socket portion may be formed adjacent the aft end the housing body portion 32 for the reception of a conventional lock cylinder as shown in the handle of the above mentioned Newman U.S. Pat. No. 4,892,342, for example. However, outside door handles assemblies for the rear doors of a four-door sedan vehicle, such as the handle assembly 20, does not require a lock cylinder and accordingly is omitted from the present description.

In FIGS. 1 and 5 a flush-type release handle, generally indicated at 60, is shown normally pivotally received in its retracted inoperable position closing the upper portion of the housing recess "R". The release handle 60 is depicted in FIG. 13 adapted to be moved about its pivot axis "A" in a counterclockwise direction from its normal full line inoperative position flush with the outer surface of the door panel 18 to its phantom line extended operable position wherein it is grasped by the operator and rotated outwardly. The release handle 60 is rotated against the force of the coil spring 50 which normally biases the handle in its retracted position in the recess "R".

The release handle 60 is integrally formed with a first elbow-shaped lever or crank arm 62 shown in FIG. 2 projecting through slot 64 (FIG. 15) in the housing body portion. The slot 64 is aligned with an associated passageway formed between the first bracket pair of support walls 42 and 43 for receiving the first lever arm 62 therein. Similarly, a release handle second elbow-shaped crank arm 66 is adapted to project through aft slot 68 (FIG. 15) in the body portion 32 aligned with an associated passageway formed between the second bracket pair of support walls 45 and 46.

In FIG. 4, it will be seen that the coil spring 50 one end radial length 70 is captured in a groove 72 formed in the housing body and its other end axial length 74 retained in a hole 76 formed in the handle first crank arm 62. The spring biases the release handle 60 toward its normal inoperative position of FIG. 13 in the recess "R". The coils of spring 50 are in pressure contact with the pivot pin 49 so as to transfer the springs' reaction force to the pivot pin 49.

As best seen in FIGS. 5 and 16, the upper portion of the housing body 30 has an elongated gaped clearance 77 co-extensive with a generally rectangular sectioned elongated internal retaining rib 78. FIG. 16 shows the retaining rib 78 extending generally horizontally between the first and second bracket opposing support walls 43 and 45, respectively. It will be noted in FIG. 16 that the retaining rib 78 has an outboard directed riser face **78*a* setback inboard a predetermined dimension "D" from a plane which includes the backside of the terminal flange end sectors 37 and 38. The setback dimension "D" is substantially equal to but slightly greater than the thickness of the panel 18** for a reason to be explained.

With reference to FIGS. 11 and 16, it will be seen that the rib 78 is provided with at least a pair of longitudinally spaced protruding formations or tabs **78*b* extending outboard from undersurface 78*c* of the rib. As best seen in FIG. 11, each tab 78*b* defines, with a portion of the setback face 78*a*, a plurality of generally right-angled positioning internal corner junctures 78*e***.

Figure 19:
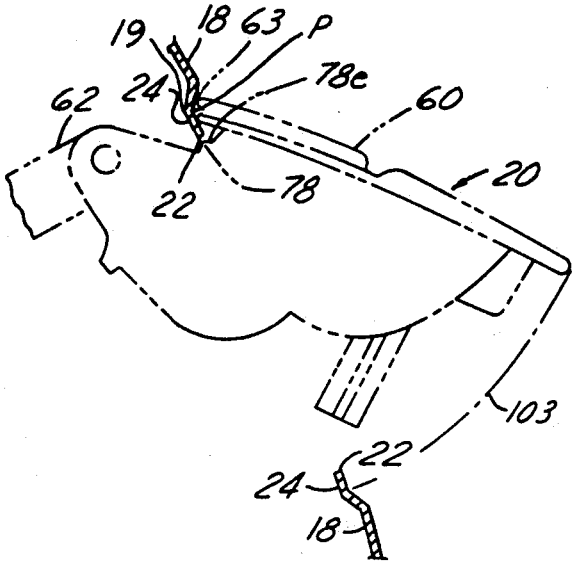
FIGS. 19, 19A are schematic side views for illustrating the rockable installation sequence of the handle housing.

Thus, with reference to the installation schematic FIG. 19, the door handle assembly 20 is installed from the exterior surface of the panel 18 by first tilting the handle assembly 20 toward the horizontal enabling the crankarms, as seen by crankarm 62, to lead the handle housing assembly through the panel aperture 22. As the crankarms are inserted in the panel aperture upper longitudinal edge 63 of the handle 60 is initially received in longitudinally extending notched juncture 19 thereby establishing an installation pivot "P". The installation pivot "P" defines a longitudinal axis enabling the installer to rock the housing into the aperture along a predetermined swingline 103.

Figure 19A:
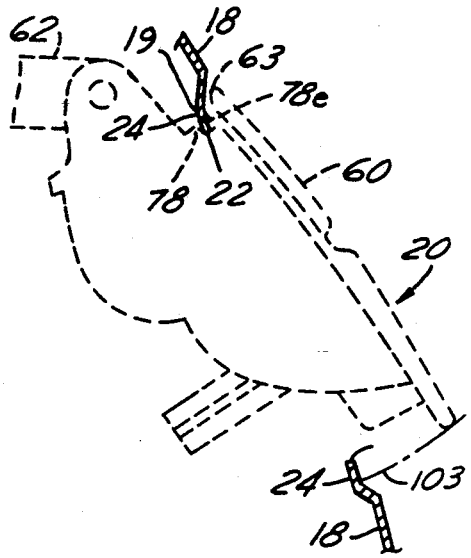

The installer rocks the handle assembly in a clockwise direction into the panel aperture from its tilted position of FIG. 19 to an intermediate position of FIG. 19A. At the position of FIG. 19A, it will be noted that the aperture free upper edge 22 is engaged by the pair of substantially right-angled positioning junctures, as seen by juncture **78*e* in FIG. 11A. It will be appreciated that the plurality of junctures 78*e* positively locate the handle assembly by enabling the installer to continue rotating the handle assembly along the swingline 103 to its installed position shown in FIG. 11**.

Figure 18:
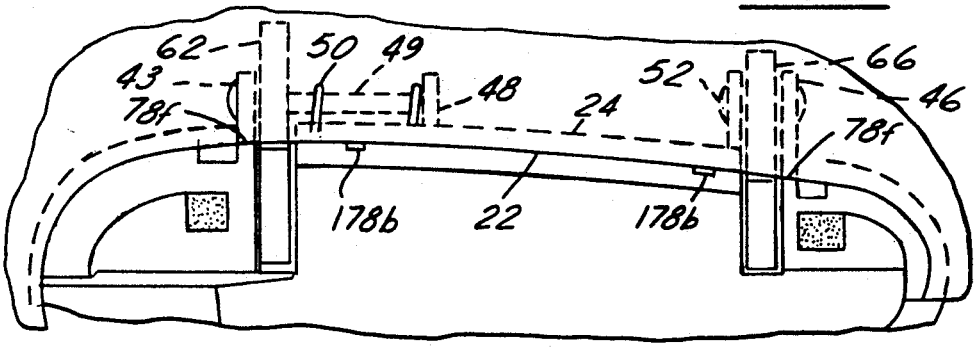
FIG. 18 is a fragmentary vertical sectional view, partly in elevation, taken substantially on the line 18—18 of FIG. 17.

With reference to FIG. 5 and 16, it will be observed that the opposite bracket support walls 42 and 46 are each formed with substantially right-angled positioning notches **78*f* adapted to engage the panel aperture upper edge 22 in a similar manner as the notched junctures 78*e* in FIG. 11A. Thus, as seen in FIG. 18, the handle assembly 20 is positively located to the aperture upper edge 22 by four supporting junctures; i.e., the two inner tab junctures 78*e* and the two outer bracket junctures 78*f*. As the panel aperture 22 in the disclosed embodiment is generally oval-shaped in configuration, it will be appreciated that the additional bracket junctures 78*f*** insure correct location of the handle assembly in the panel aperture.

Figure 17:
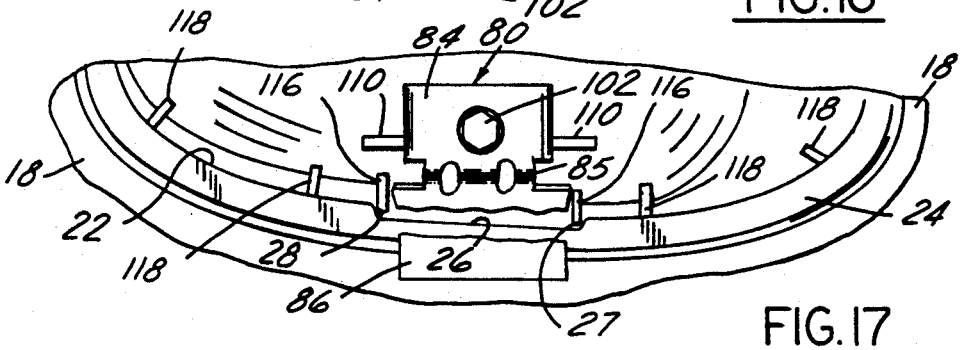
FIG. 17 is a fragmentary view of the inboard lower side of the handle assembly shown installed in the door panel opening.

With reference to FIG. 17, it will be seen that a plurality of integrally molded positioning fillets 116 are formed on the backside of housing central body portion 32 so as to fictionally engage the panel aperture lower arcuate edge 22 upon the handle assembly 20 being seated on the flanged border 24. In addition, a pair of inner guide fillets 116 are integrally molded on the housing central body portion 32 spaced a predetermine dimension apart. It will be noted that each guide fillet 116 is adapted to fictionally engage an associated border cutout beveled edge 27 and 28, respectively, insuring the exact longitudinal location of the handle assembly 20 in the panel oval aperture 22 relative to the cutout 26.

Figure 20:
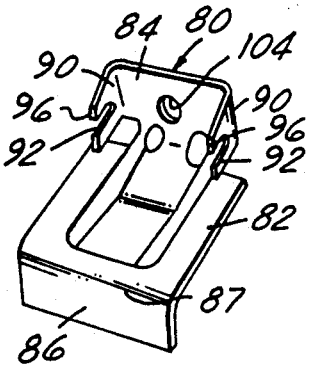
FIG. 20 is a detail perspective view of the attaching clip of the present invention.
Figure 21:
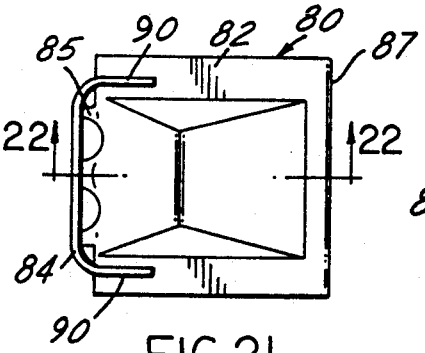
FIG. 21 is a top plan view of the clip shown in FIG. 20.
Figure 24:
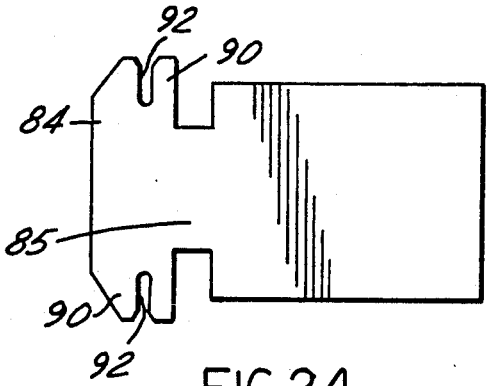
FIG. 24 is plan view of the blank from which the clip is formed.

As viewed in FIGS. 3, 16 and 20, the handle housing locking means comprises a one-piece spring sheet metal clip, generally indicated at 80. The clip 80 is initially in the form of a stamped lanced flat blank 81, shown in FIG. 24, and is subsequently formed by suitable stamping machine dies to the clip member configuration of FIGS. 20–23.

Figure 22:
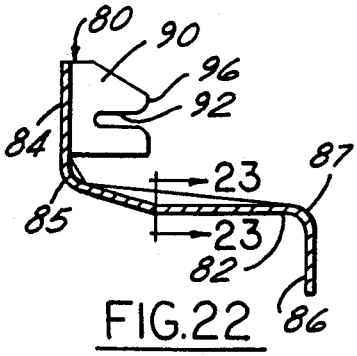
FIG. 22 is a side view of the clip of FIG. 20.
Figure 23:
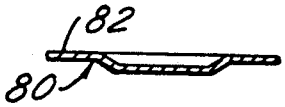
FIG. 23 is a vertical sectional view taken on the line 23—23 of FIG. 22.

The clip 80, as seen in FIG. 20, has a generally double-L shape in longitudinal cross-section comprising a planar base plate 82 bent to define an upstanding head flange 84 at one end and a downwardly directed foot flange 86 at the opposite end. As seen in FIG. 22, the head 84 and foot 86 flanges are disposed in generally parallel relation with each other. It will be noted in FIG. 3 that the head flange 84 is integrally joined to the body plate 82 by a central radiused sectioned neck portion 85 providing a transversely extending bend juncture while the foot portion 86 is integrally joined to the base plate 82 by a transverse bend juncture 87.

As best seen in FIG. 17, the head portion 84 is generally channel-shaped in horizontal section defining a pair of right-angled outwardly extending parallel ears 90 overlying the base plate 82. The pair of ears 90 have horizontally aligned open edge slots 92 of predetermined length terminating in their associated ear free vertical edges 96.

With reference to FIGS. 3, 5 and 16, the housing central body 32 is integrally formed with an inboard extending central stem portion 100 having its free end provided with an axial bore 101 (FIG. 8) adapted to threadably receive therein a suitable fastener member, such as a self tapping screw generally indicated at 102 in FIG. 3. FIG. 3 shows the clip member head portion 84 having a central hole 104 therein adapted to receive threaded shank 106 of the fastener 102 for fixedly attaching the clip 80 on the housing stem free end.

FIG. 3 depicts the stem portion 100 formed with a pair of horizontally aligned mirror image blade-like side stem fins 110 each integrally molded with the housing and disposed on either side of the stem portion. The fins 110 lie in a horizontal plane that includes the principal axis 112 of the stem portion. An upper vertical disposed blade 111 is integrally molded with the housing to strengthen the stem member. A pair of vertically disposed locating fillets 116 are formed at the juncture 117 of the housing central body 32 and the terminal flange 34. The locating fillets 116 are positioned in a mirror image manner on either side of the stem portion principal axis 112 and are spaced a predetermined dimension slightly greater than the width of the clip 80. It will be noted in FIG. 4 that a plurality of guide fillets 118 are spaced along the housing juncture 117 to exactly position the handle assembly 20 in the panel aperture.

As the handle assembly 20 is installed from the outboard side of the panel 18 through the substantially oval-shaped panel aperture 22 in a rocked manner an upper central portion of the aperture flanged border 24 is inserted into the elongated clearance 77 until the aperture free edge 22 is in seated contact with the tabs 78*b* as seen in FIGS. 11 and 11A. The operator next rotates the housing inboard along the swingline 103 wherein the backside of the terminal flange 34 is seated on the flanged border outer surface while the retaining rib outboard face 78*a* is seated on the flanged border inner surface.

The installation of the handle assembly 20 is completed by clamping the lower central portion of the terminal flange 34 to the panel aperture flanged border 24 by means of the retaining clip 80. It will be noted in FIG. 10 that as the tapping screw 102 is tightened the clip foot flange 86 is urged outboard so as to bears on the inner surface of the flanged border clamping the housing terminal flange against the aperture flanged border 24.

While there is described above the principles of this invention in connection with a specific embodiment, it is to be clearly understood that this description is made only by way of example and not as a limitation to the scope of this invention.

What is claimed is:

1. In a handle housing adapted for mounting in an aperture formed in vehicle body panel having exterior and interior surfaces, said housing formed with a terminal flange surrounding a central body portion, said terminal flange having a backside thereof adapted for seating on a flanged border surrounding said panel aperture, said housing provided with means supporting a handle thereon, an arrangement for mounting said housing in said aperture comprising:

said housing having an elongated upper retaining rib extending generally longitudinally between a pair of longitudinally spaced brackets upstanding from said body portion, said rib provided with an outer face offset a predetermined dimension from a plane that includes said terminal flange backside, said housing having notch means formed thereon;

said housing terminal flange formed with an upper elongated omitted segment extending generally horizontally a predetermined dimension between said brackets, said handle in its non-use state having an inner surface juxtaposed an outer face of said terminal flange so as to bridge said omitted segment thereby defining an elongated clearance intermediate said rib offset face and said release handle inner surface;

whereby an installer inserts said housing in said aperture from the exterior of said panel by tilting said housing such that said pair of brackets are initially inserted through said panel aperture wherein an upper edge portion of said flanged border received in said clearance engages said notch means establishing an installation axis about which said housing is rocked downwardly seating said terminal flange on said flanged border with said rib face abutting an opposed interior surface of said panel;

a clip secured to said housing body portion by a threaded fastener, said clip being so configured wherein tightening of said fastener urges a portion of said clip into abutment with a lower inner surface portion of said flanged border thereby locking said housing in said panel aperture.

2. The handle housing mounting arrangement as set forth in claim 1 wherein said retainer clip member comprising a one-piece member having a generally double-L shape in vertical section defining a base panel, an apertured head panel upstanding from one end of said base panel, and a foot panel depending from an opposite end of said base panel.

3. The handle housing mounting arrangement as set forth in claim 2 wherein said head panel being-channel shaped in horizontal section defining a pair of right-angled ears projecting outboard therefrom, said ears having generally horizontally aligned open-ended slots provided therein, said housing stem formed with a pair of horizontally disposed fins disposed on either side thereof, whereby with said housing in said panel aperture said clip head panel is aligned on said stem by each said ear slot receiving an associated fin herein.

4. The handle housing mounting arrangement as set forth in claim 2 wherein said housing central body in the form of an outwardly opening concavo-convex shaped recessed portion defining an interior dome-like surface divided from said terminal flange by a radiused contour line, said aperture border provided with an elongated central cutout formed in a lower edge thereof having a longitudinal dimension between fore and aft cutout beveled edge portions slightly greater than the width of said clip foot panel, a pair of vertically disposed longitudinally spaced guide fillets formed at said housing radiused contour line adapted to be received in said border cutout juxtaposed an associated cutout beveled edge.

5. The handle housing mounting arrangement as set forth in claim 1 wherein said notch means in the form of a plurality of tabs projecting outboard from said rib defining with said rib face a plurality of substantially right-angled junctures.

6. The handle housing mounting arrangement as set forth in claim 1 wherein said notch means being formed in each said housing bracket.

7. The handle housing mounting arrangement as set forth in claim 1 wherein said aperture having a generally oval shape.

8. The handle housing mounting arrangement as set forth in claim 1 wherein said panel aperture flanged border is recessed inwardly from the exterior surface of said panel.

* * * * *